US011253413B2

(12) United States Patent
McClain

(10) Patent No.: US 11,253,413 B2
(45) Date of Patent: Feb. 22, 2022

(54) INTEGRATED DISSECTION BOARD TABLE LID

(71) Applicant: MP ACQUISITION, LLC, Oak Park, MI (US)

(72) Inventor: Michael S. McClain, Waterford, MI (US)

(73) Assignee: MP ACQUISITION, LLC, Madison Heights, MI (US)

( * ) Notice: Subject to any disclaimer, the term of this patent is extended or adjusted under 35 U.S.C. 154(b) by 237 days.

(21) Appl. No.: 16/567,230

(22) Filed: Sep. 11, 2019

(65) Prior Publication Data

US 2020/0085661 A1 Mar. 19, 2020

Related U.S. Application Data

(60) Provisional application No. 62/730,753, filed on Sep. 13, 2018.

(51) Int. Cl.
*A61G 13/00* (2006.01)
*A61G 13/10* (2006.01)
(Continued)

(52) U.S. Cl.
CPC ..... *A61G 13/0027* (2013.01); *A61G 13/10* (2013.01); *A47B 21/02* (2013.01); *A47B 2037/005* (2013.01)

(58) Field of Classification Search
CPC ... A47B 2037/005; A47B 77/06; A47B 96/00; A47B 31/00; A47B 21/02; A61G 15/14;
(Continued)

(56) References Cited

U.S. PATENT DOCUMENTS 1,522,282 A * 1/1925 McClintic ..... A61G 13/0027 27/23.1
1,793,489 A * 2/1931 Johnson ..... A61G 13/0027 27/23.1
(Continued)

FOREIGN PATENT DOCUMENTS

| | | |
|---|---|---|
| CN | 2449660 | 9/2001 |
| CN | 105997414 | 10/2016 |
| JP | 2003319943 | 11/2003 |

OTHER PUBLICATIONS

Apzem—Grossing Workstation, Jun. 20, 2016 (dating is based on Google Search); Table Top Grossing Station (AT Series) Retrieved from the Internet. URL: http://www.grossingstation.com/table-top-grossing-station-2/; Formaldehyde Monitor in Grossing Workstation—Retrieved from the Internet. URL: http://www.grossingstation.com/formaldehyde-monitor/.
(Continued)

*Primary Examiner* — David R Hare
*Assistant Examiner* — Madison Emanski
(74) *Attorney, Agent, or Firm* — Raggio & Dinnin, P.C.

(57) ABSTRACT

An anatomy table for use in autopsies and dissections comprises a base and an immersion storage tank arranged in the base. The anatomy table further comprises a dissection lid arranged on the base, wherein the dissection lid covers the immersion storage tank in its closed position. The table also comprises a hinge secured between the dissection lid and a top edge of the base, wherein the dissection lid rotates about the hinge between a first and second position, wherein the first position allows for access to the body stored in the anatomy table immersion storage tank while the second or closed position of the dissection lid allows for dissecting to occur directly on top of the anatomy table.

20 Claims, 2 Drawing Sheets

(51) Int. Cl.
*A47B 37/00* (2006.01)
*A47B 21/02* (2006.01)

(58) Field of Classification Search
CPC . A61G 13/0027; A61G 13/10; A47L 15/4212; A47C 17/66
See application file for complete search history.

(56) References Cited

U.S. PATENT DOCUMENTS

| | | | | |
|---|---|---|---|---|
| 2,512,747 | A | | 6/1950 | Lewis |
| 2,702,505 | A | | 2/1955 | Nelson |
| 3,034,843 | A | * | 5/1962 | Moon ..... A61G 17/002 312/236 |
| 3,054,650 | A | * | 9/1962 | Nordland ..... A61G 13/0027 312/209 |
| 3,799,534 | A | | 3/1974 | Coles |
| 3,874,754 | A | | 4/1975 | Saunders |
| 4,038,974 | A | | 8/1977 | Pielkenrood |
| 4,140,105 | A | | 2/1979 | Duvlis |
| 4,402,144 | A | | 9/1983 | Dumke |
| 4,422,369 | A | | 12/1983 | Smets |
| 4,650,171 | A | | 3/1987 | Howorth |
| 4,876,773 | A | | 10/1989 | Wade |
| 4,898,089 | A | | 2/1990 | Roos |
| 4,901,410 | A | | 2/1990 | Fischer et al. |
| 4,980,956 | A | | 1/1991 | Fischer et al. |
| 5,042,456 | A | | 8/1991 | Cote |
| 5,093,969 | A | | 3/1992 | McGuire |
| 5,181,883 | A | | 1/1993 | Hofstra et al. |
| 5,244,433 | A | | 9/1993 | Utterback |
| 5,303,659 | A | | 4/1994 | Berlin et al. |
| 5,620,467 | A | | 4/1997 | Change |
| 5,621,929 | A | | 4/1997 | Smith |
| 5,904,162 | A | | 5/1999 | Ferguson et al. |
| 6,050,660 | A | | 4/2000 | Gurley |
| 6,279,510 | B1 | | 8/2001 | Batterton |
| 6,694,892 | B2 | | 2/2004 | Lin et al. |
| 7,428,882 | B2 | | 9/2008 | Keil |
| 7,468,161 | B2 | | 12/2008 | Reinhardt et al. |
| 9,463,129 | B2 | | 10/2016 | Hallman |
| 2003/0033790 | A1 | | 2/2003 | Hague |
| 2005/0180948 | A1 | | 8/2005 | Irwin |
| 2006/0154590 | A1 | | 7/2006 | Kanaya |
| 2006/0180057 | A1 | | 8/2006 | Hallman |
| 2008/0202491 | A1 | | 8/2008 | Eberhand |
| 2012/0037049 | A1 | | 2/2012 | Martin et al. |
| 2012/0260418 | A1 | | 10/2012 | Rundberg et al. |
| 2015/0052975 | A1 | | 2/2015 | Martin |
| 2015/0079894 | A1 | | 3/2015 | Zimmerman |
| 2017/0087040 | A1 | | 3/2017 | Hallman |
| 2017/0360639 | A1 | | 12/2017 | Corona et al. |

OTHER PUBLICATIONS

Mortech-Manufacturing Inc., product catalog. (Apr. 27, 2016) (Apr. 27, 2016) Retrieved from the Internet at URL:http://fliphtml5.com/unzu/srpk/basic/151-200.

* cited by examiner

INTEGRATED DISSECTION BOARD TABLE LID

This application claims the benefit of U.S. Provisional Patent Application 62/730,753—Filed: Sep. 13, 2018

BACKGROUND OF THE INVENTION

1. Field of the Invention

The present invention generally relates to an anatomy table, immersion table, or a dissection table, and more particularly relates to an integrated dissection board table lid incorporated with an anatomy table or immersion table.

2. Description of Related Art

Autopsy tables, grossing tables, necropsy tables, anatomy tables, immersion tables, dissection tables, and trimming tables are all well known in the art. These tables are designed to accommodate a body or other parts of a body, while a post mortem examination is carried out, pathology is carried out, pathology is conducted on an organ or other body part or teaching is occurring in an anatomy lab or the like. Many of these prior art autopsy tables and/or grossing stations were made of simple ceramic slabs with no exhaust systems. Recently, prior art autopsy tables have been made of a stainless steel having a discontinuous or perforated surface. These tables may have a ventilation system to reduce the odor associated with chemicals, natural fluids and components that are associated with an autopsy or pathology procedure. The use of ceramic slabs or stainless steel create an easy to clean surface that generally is non porous and easy to disinfect after each autopsy or pathology procedure is conducted thereon.

It should be noted that in the prior art it would be advantageous to dual purpose space and equipment to cover the many different process needs that occur in any known anatomy lab, necropsy lab or medical examination office. In an effort to create dual purpose equipment in an anatomy lab there is a need in the art to combine an anatomy table or immersion table with a dissection table. There also is a need in the art to integrate a cutting board surface into a top or lid of an anatomy table or immersion table. There also is a need in the art for a table that may allow samples to be removed from a storage area of an anatomy table or immersion table located underneath a lid fixed thereon in order to perform dissection on the sample on top of that same lid when that lid is in its closed position. This may allow for a single integrated anatomy table to do both storage and dissection on the same device without having to have two separate tables arranged in the office, i.e., one for storing and one for performing a dissection thereon. There also is a need in the art to reduce the amount of tables and other work surfaces in a laboratory, such that a single table may perform multiple procedures, hence improving the efficiency of the laboratory in a novel and more cost effective and space saving manner.

SUMMARY OF THE INVENTION

One object of the present invention may be to provide a novel and unique anatomy table.

Another object of the present invention may be to provide an anatomy table that has an integrated dissection board table lid arranged thereon.

Still another object of the present invention may be to provide an anatomy table that combines both the function and components of an anatomy table with a dissection table.

Yet another object of the present invention may be to provide an anatomy table that includes a cutting board surface arranged via a hinged lid to a top surface thereon.

Still another object of the present invention may be to provide an anatomy table that allows for samples to be removed from a storage area within the table underneath the lid and then allow the same person to perform dissection on that same lid when it is in its closed position.

Still another object of the present invention may be to provide an anatomy table that is more cost effective and reduces the number of tables or equipment required in a laboratory, but still allow the same procedures to be performed in the lab space in a more cost effective and ergonomically pleasing manner.

According to the present invention, the foregoing and other objects and advantages are obtained by a novel design for an anatomy table for use in autopsy, necropsy or pathology procedures. The anatomy table comprises a hinged table top or lid arranged to a top surface of a base of the anatomy table. The base generally has a rectangular shape and may include a wheel arranged on each corner thereof. The anatomy table may also include a storage tank or area arranged underneath the hinged table top to allow for storage of specimens or other materials or components that may be used in an anatomy lab or the like. The anatomy table may also include a handle arranged on one end thereof to allow for movement of the anatomy table to a predetermined position within an anatomy lab or other laboratory. The hinged table top or lid may be made of a polymer, such as a polyethylene, but may also include other materials such as cork, wood or any other natural or man made material. The integrated dissection board table lid used in conjunction with the anatomy table may allow for a two in one table to reduce the need for additional space and equipment in a laboratory while also allowing all of the intended procedures of an anatomy lab or other laboratory to occur in a more efficient and cost effective manner. It should also be noted that it is contemplated to use different methodologies to move the lid into position on top of the anatomy table or other types of dissection tables, storage and transfer carts or any other type of component or equipment used in anatomical examination spaces and laboratories. It is also contemplated to use a vented version of the integrated dissection board table lid with the anatomy table invention in some contemplated embodiments.

One advantage of the present invention may be that it provides a novel and unique anatomy table.

Another advantage of the present invention may be that it provides for an anatomy table having an integrated dissection board table lid thereon.

Still another advantage of the present invention may be that it provides an anatomy table that combines a dissection table therewith thus creating a two for one benefit with regards to equipment and components needed in a laboratory.

Yet another advantage of the present invention may be that it provides an anatomy table that integrates a cutting board surface into a hinged table top or lid arranged on the anatomy table or immersion table.

Still another advantage of the present invention may be that it provides an anatomy table that allows for samples to be removed from a storage area used for storage under the hinged lid arranged thereon and then allowing dissection on the specimen to be performed on the same lid when it is placed in the closed position.

Yet another advantage of the present invention may be that it provides an anatomy table that reduces the need for a second table or work surface in a lab but still allows the anatomical procedure to be performed in the same or smaller laboratory space in a more cost efficient manner.

Other objects, features and advantages of the present invention will become apparent from the subsequent description, and appended claims taken in conjunction with the accompanying drawings.

DESCRIPTION OF THE EMBODIMENT(S)

Figure 1:
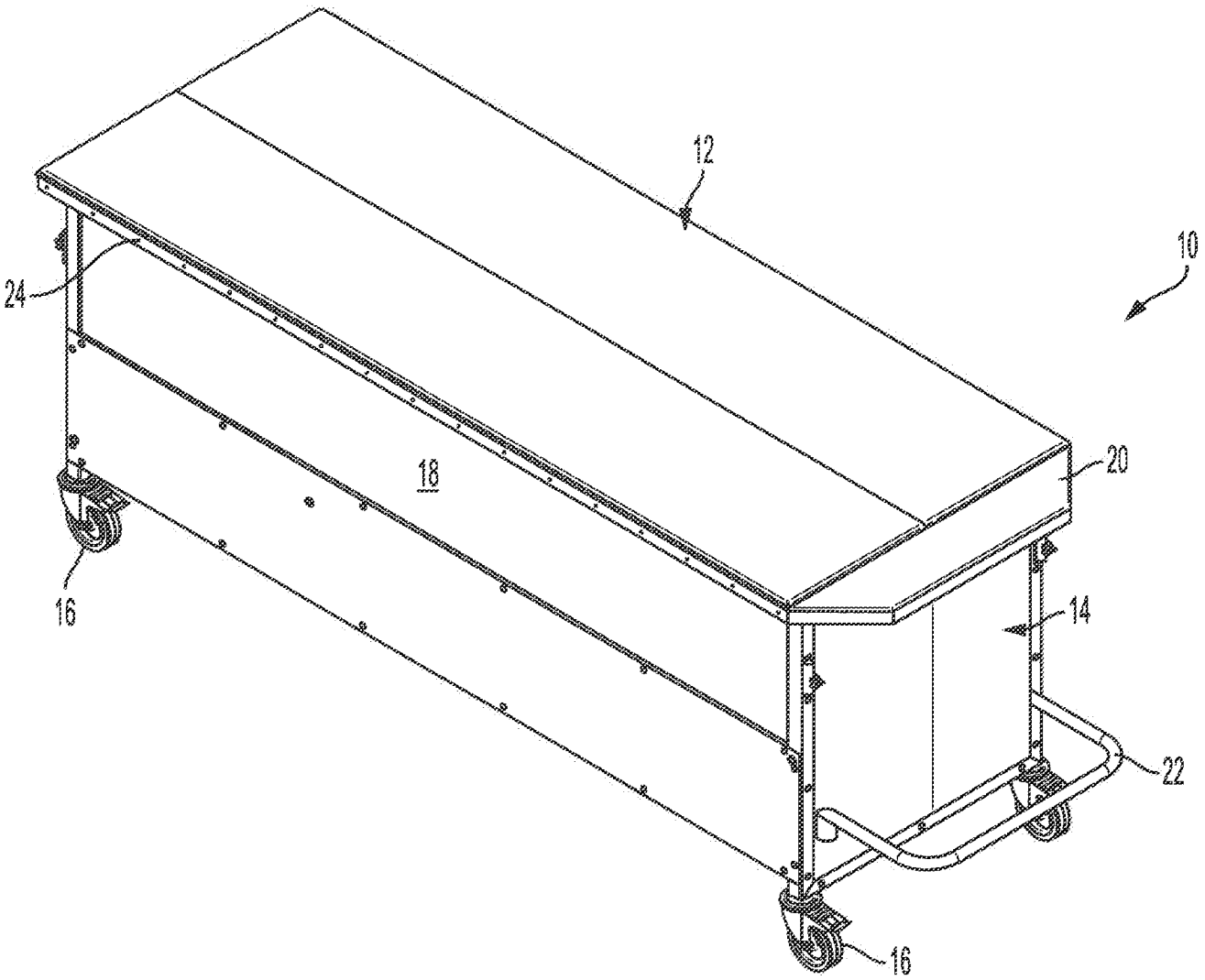
FIG. 1 shows a perspective view of an anatomy table with an integrated dissection board table lid according to the present invention.
Figure 2:
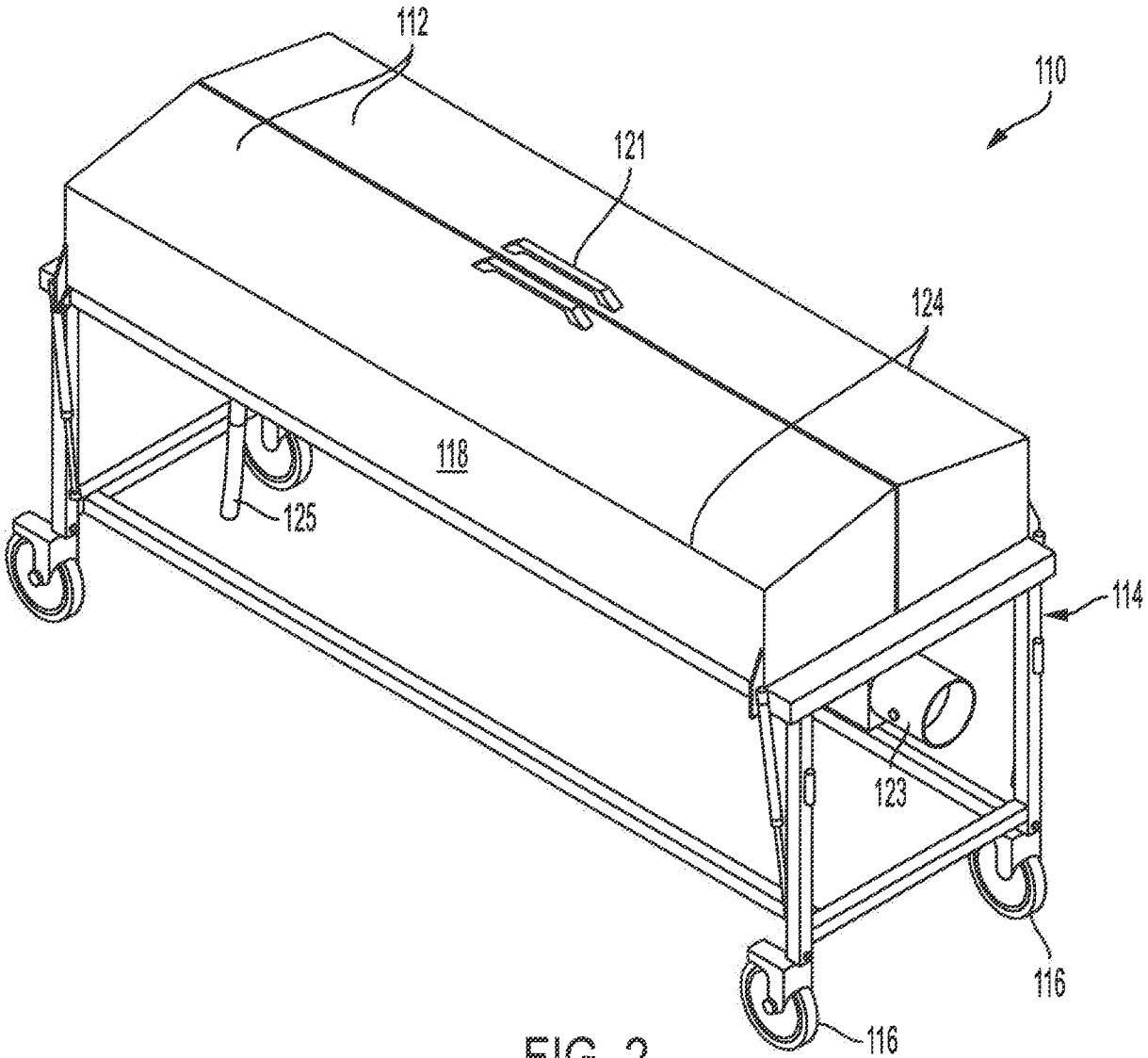
FIG. 2 shows a perspective view of an anatomy table with an integrated dissection board table lid according to an alternate embodiment of the present invention.

Referring to the drawings, an anatomy table 10 having an integrated dissection board table lid or table top 12 is shown according to the present invention. It should be noted that the anatomy table 10 shown in the figures may be used in any known autopsy, necropsy, trimming, pathology, anatomical, or any other procedure performed on tissues, specimens, bodies or the like all of which are for use in hospitals, morgues, funeral homes, laboratories, anatomy teaching labs or any other structure that may be used for examining human or animal bodies or human and animal body parts. It should be noted that an anatomy table 10 is generally shown in the drawings, but the present invention of an integrated dissection board table lid 12 may be used for other applications, such as but not limited to any known dissection tables, storage and transfer carts which may be used in anatomy examination stations or laboratories, immersion tables, grossing stations, or any other type of table or component that may be used in laboratory settings or medical examination offices which may require or need dual purpose tables for use in a predefined laboratory space thus allowing for many different needs to be processed with one piece of equipment arranged within the lab. It should further be noted that storage, and examination/dissection functions needed within a lab are combined in this invention, such that an anatomy table or immersion table 10 may be combined with a dissection table thus creating a device that may allow samples to be removed from a storage area arranged under a hinged table or lid 12 which may allow for the specimen stored under the lid 12 of the table 10 to have dissection performed thereon on that same lid 12 that covers the storage area when that lid 12 is placed in its closed position. Using this dual combination equipment or component within any known laboratory may reduce the costs to the owner of the laboratory by not requiring a second table or work surface to be purchased. This may allow the procedures needed to be performed in the lab to be performed in a similar space with only one piece of equipment, thus reducing the overall costs and increasing the efficiency of the work space for the laboratory.

The anatomy table 10 of the present invention generally may include a base 14, which generally is arranged on a floor or other surface in the lab or room in which the anatomy table 10 may be used. The anatomy table base 14 may include a plurality of wheels 16 arranged at predetermined positions on a bottom surface thereon. In the embodiment shown, a wheel 16 is placed at each corner of the generally rectangular anatomy table base 14. It should be noted that in the embodiment shown the anatomy table base 14 generally has a rectangular shape, however any other known shape, such as but not limited to square, triangular, oval, circular, or any other known shape may be used for the anatomy table base 14 and hence anatomy table 10. The anatomy table base 14 may include a first, second, third and fourth leg arranged at each corner thereof. The anatomy table 10 of the present invention may include a first, second, third and fourth wall extending from the table top 12 and defining the outer walls of the base 14 of the anatomy table 10 according to the present invention. It should be noted that it is also contemplated to not use the walls described above and just use corner members or legs arranged between the wheels 16 and a surface of the table top 12 according to the present invention. The anatomy table 10 according to the present invention may also include an internal storage area or immersion storage tank 18. The storage area 18 is arranged directly below the lid 12 and may be of any size. The size of the storage arm 18 may be such that is capable of holding a body or cadaver and/or only smaller components of the body or cadaver. The anatomy table 10 may also include a handle or shelf 20 arranged off one top end of the lid 12 and a handle or bar 22 arranged off a predetermined portion of the base 14 on one end thereof. In one contemplated embodiment, the handle or bar 22 is arranged at a position approximately one quarter to one half of a distance upward from a bottom edge of one end side of the anatomy table 10. This handle 22 may generally have a U-shape and may be connected to one of the end surfaces of the base 14 or at either of the first and second legs that may form one of the corner posts of the base 14 of the anatomy table 10.

The anatomy table 10 may also include an internal storage area or immersion tank area 18 arranged directly adjacent to and below the table top 12 of the anatomy table 10. The storage area 18 generally has the shape of a rectangular trough extending the entire length and width of the base 14 of the anatomy table. A bottom surface of storage area 18 may be arranged at any predetermined position between the four outer corners of the anatomy table base 14. In one contemplated embodiment as shown in the drawing, the bottom surface of the immersion tank 18 is arranged approximately at a mid way point of the height of the anatomy table base 14. It should be noted that the storage tank 18 of the present invention generally may have a rectangular shape that mimics that of the base 14 of the anatomy table 10, however any other known shape may be used for the storage tank 18 and only a portion of the area defined by the walls or legs of the base 14 may be used for the storage tank 18. It is also contemplated to have a plurality of different size storage tanks 18 arranged along the entire length of the base 14 or have one large storage tank arranged therein. It is also contemplated that the storage tank 18 may be vented to allow for venting of any fumes that may be associated with specimens stored within the storage tank 18 and the venting may be connected directly to outside air or to other filters arranged therein. However, it is also contemplated to have the storage tank 18 used without venting and to have any known configuration as noted above for any number of storage areas 18 arranged therein, with different size and shape storage compartments arranged within the overall storage tank 18 and area thereof of the integrated anatomy table 10 as described herein. It should be noted that all of the components described herein generally are made of a stainless steel material unless otherwise noted, however any other known metal, plastic, ceramic, composite or natural material may be used for any of the components described herein.

Attached to a top of the anatomy table 10 according to the present invention may be a table top 12. In one contemplated embodiment, the table top or lid 12 has a generally rectangular shape. However, it should be noted that any other shape may be used for the table top or lid 12 depending on the design of the anatomy table base 14 and the environment in which the anatomy table 10 may be used. The table top 12 of the present invention may have integrated therein a cutting board surface arranged on the top surface thereof and also may be hinged or connected in some other method to a surface of the base 14 of the anatomy table 10 to allow for movement of the table top or lid 12 between an open and closed position, with respect to the base 14 of the anatomy table 10. In one contemplated embodiment, the top surface or cutting surface of the table top or lid 12 may be made of a polymer such as a polyethylene, however it should be noted that any other known plastic, ceramic, or metal, or natural material, such as but not limited to cork, wood, etc., may also be integrated or used to completely form the table top or lid 12 of the anatomy table 10 according to the present invention. As shown in the drawing, the table top or lid 12 may be two separate pieces that form a multi-hinged top for the entire anatomy table 10, As shown in the drawings, a first and second generally rectangular shaped piece forms a larger rectangular lid 12 that may cover the entire top surface of the base 14 of the anatomy table 10. It is contemplated that the two piece anatomy table lid 12 may be hinged on both sides thereon to allow for opening of each piece of the anatomy table lid 12 to a person performing the dissection or anatomy procedures. This may allow access to the storage tank or storage areas 18 underneath the lid 12 of the anatomy table 10. In one contemplated embodiment a hinge 24 is arranged along the entire length of the long portion of one of the first rectangular lid portions of the anatomy table top 12 and a hinge 24 may be arranged on the second portion of the anatomy table top 12 along one of its long edges. It should be noted that the hinge 24 may be connected via any known fastener to both a surface of the lid 12 and to an opposite surface arranged near a top of the base 14 of the anatomy table 10. The use of the hinge 24 may allow for either one or both of the section of the anatomy table lid 12 to be rotated into an open position such that access to the storage tank 18 arranged there under may be had. It should be noted that it is contemplated that the rotation may allow for either section of the lid 12 to be rotated approximately 270° or any other number of degrees between a closed and open position. It should be noted that it is also contemplated to use one large rectangular lid 12 for the integrated dissection board table lid 12 for the anatomy table 10 such that only one hinge or other connection methodology may be needed to open the entire lid 12 in a rotating or other manner with respect to the base 14 of the anatomy table 10. It is also contemplated that only one of the two pieces of the hinge lid 12 may be capable of movement with respect to the base 14 while the second portion of the two piece lid 12 is fixed in position with respect to the top surface of the anatomy base 14. It should further be noted that it is also contemplated that other methodologies may be used other than a hinge method to connect the anatomy table lid 12 to the anatomy table base 14. These other methodologies may include but are not limited to a slide mechanism that allows for the anatomy lid 12 to slide in a predetermined direction, thus allowing access to the storage tank 18 arranged there under, a snap or latch system that allows for the table top lid 12 to be snapped into position with respect to the anatomy table base 14 or even a methodology that allows for an anatomy table lid 12 to have predetermined cutout portions or pockets in the top surface of the lid 12 to allow for replacement of the polymer or other cutting board surface arranged in the predetermined shaped pockets. The use of this integrated cutting surface in the lid 12 of the anatomy table 10 may reduce the need for additional space and equipment in the laboratory and also allow for a more efficient and cost effective laboratory. It is also contemplated to have a locking mechanism on the lid 12 in order to allow for the user to lock the lid 12 thus allowing for safety of the specimens stored in the storage area 18 of the anatomy table 10. It is also contemplated to have a plurality of locking surfaces and locking shoulders arranged on the bottom surface of the lid 12 and a top portion of the anatomy base 14 in order to allow for a secure non-moving fit when the anatomy table lid 12 is in its closed position and a dissection is occurring on the top of the hinged lid 12. It is also contemplated that the anatomy table lid 12 may be made of a combination of a polymer material in conjunction with a metal or any other material or the anatomy lid 12 may be made entirely with a polymer material.

Referring to the drawings, an alternate embodiment for an anatomy table 10 having an integrated dissection board table lid or table top 12 is shown according to the present invention. Like numerals indicate like parts. The alternate embodiment anatomy table 110 includes a base 114 generally having a first, second, third and fourth leg member, each having a wheel 116 arranged or connected at a bottom portion thereof. A plurality of reinforcing cross members are arranged between the legs in a generally rectangular manner. It should be noted that these legs and cross members generally have a rectangular or square tube like shape. It should further be noted that in cross section the leg members may have a square like cross section, a triangular like cross section, a circular like cross section or any other shaped cross section. The base 114 may also include a flat planar table top surface arranged at a top portion of the legs. Generally, this table top portion is rectangular in shape, however any other shape may be used. Arranged on a top surface of the rectangular table top surface may be a storage area 118. The storage area 118 generally has a rectangular shape with a predetermined depth, wherein the depth is large enough to hold a body or cadaver therein for use during anatomy or autopsy procedures thereon. The two side walls of the storage area 118 generally have a rectangular shape, while the end walls of the storage area 118 generally are rectangular in shape, but may have on the top edge thereof an upwardly inclined surface meeting at a center point thereof. In cross section the end walls may have a generally rectangular shape with a predetermined shape triangle portion arranged on the top portion thereof. Arranged on a top portion of the storage area 118 may be an integrated dissection board table lid 112. This lid 112 is made of the same materials and is used for the same purposes as that described above. Generally, the lids 112 are also made of a polymer material, such as a polyethylene and are rectangular in shape and are connected via a hinge 124 to either a top edge of the storage area 118 or an edge of the table like surface of the base 114 of the anatomy table 110. As shown in the figures, a pneumatic spring may be arranged between one or more legs of the base 114 and a flange connected to the table top or a wall of the storage area 118. These pneumatic or gas cylinders may allow for adjustment of the height of the table or reduced efforts in opening the lid 112 to allow for access to the body or cadaver arranged therein. It should be noted that all of the components of the alternate embodiment anatomy table 110 are generally made of a metal, such as a steel material, however any other type of ceramic, plastic, metal, composite, natural or manmade material may also be used. However, it should be noted that the lid 112 is made of a polymer material, such as that described above. Furthermore, the two piece lid 112 of the anatomy table 110 may also include a handle 121 arranged on each lid portion at a predetermined position, such as at a mid point, as shown in the drawings, along one edge thereof in order to allow for easy opening and closing of the hinged lid 112 to allow for easy access to the cadaver and for easy cutting or dissection of a sample removed from the cadaver or from another source on the cutting board surface lid 112. The anatomy table 110 may also include a venting system 123 arranged on a bottom surface of the table top to allow for odors to be vented from the storage area 118 of the anatomy table 110. The anatomy table 110 may also include a drain member 125 arranged through the table top into the inner space or trough of the storage area 118 to allow for drainage of any fluids that may be used during the autopsy of the cadaver or body arranged therein. The hinges 124 may be connected such that they are arranged between both edges of the lid 112 and the side walls of the storage area 118 or the lids 112 may be permanently fixed to the sides of the storage area 118 and the rotation or pivoting occurs at the bottom edge of the side of the storage area 118 on both ends thereof via the gas shock cylinder system as described above. It should further be noted that any other shape may also be used for the alternate embodiment or any other contemplated embodiments of an anatomy table 110 according to the present invention.

The present description is for illustrative purposes only and it should not be construed to limited the present invention in any way. Thus, a person skilled in the art may appreciate that various modifications might be made to the present and disclosed embodiments, without departing from the scope and spirit of the present invention, which is defined in terms of the claims below. Other aspects, features and advantages may be apparent upon an examination of the attached drawing figures and appended claims.

What is claimed is:

1. A two in one anatomy table, said table comprising: a base; a storage area arranged in said base; a dissection lid arranged on said base, said dissection lid covers said storage area; a hinge secured between said dissection lid and a top edge of said base, said dissection lid rotates about said hinge along a horizontal axis between a first and a second position, and wherein said first position the dissection lid is open and wherein said second position the dissection lid is closed, said dissection lid configured for dissecting and cutting directly on a top surface of said dissection lid when said dissection lid is in said second position.

2. The table of claim 1 further comprising a wheel arranged at each corner of said base.

3. The table of claim 1 further comprising a handle arranged on one end of said base.

4. The table of claim 1 further comprising a U-shaped bar extending from an end of said base.

5. The table of claim 1 wherein said base having a generally rectangular shape, said storage area is an immersion storage tank.

6. The table of claim 1 wherein said dissection lid is a two piece lid having a first rectangular member and a second rectangular member.

7. The table of claim 6 wherein said first and second rectangular members move and pivot independently of one another.

8. The table of claim 1 wherein said dissection lid is made of polyethylene.

9. The table of claim 1 wherein said dissection lid is made of a polymer, cork or wood.

10. The table of claim 6 wherein said first rectangular member having said hinge arranged along an entire length of a first longitudinal side thereof.

11. The table of claim 10 wherein said second rectangular member having a second hinge arranged along an entire length of a second longitudinal side thereof.

12. The table of claim 11 wherein said second hinge arranged on a second top edge of said base.

13. The table of claim 1 wherein said dissection lid is partially secured to said base with a slide mechanism or a snap and latch mechanism.

14. The table of claim 1 further comprising a lock arranged on said lid.

15. The table of claim 6 wherein said first rectangular member and said second rectangular member are generally a same size.

16. A method of performing an autopsy and a dissection on a single piece of equipment in a lab, said method comprising the steps of: using a two in one table for both the autopsy and dissection, said table having a storage tank and a dissection lid pivotally arranged over said storage tank; opening said dissection lid to have access to a body for the autopsy; closing said dissection lid; and dissecting and cutting samples from said body directly on a top surface of said dissection lid.

17. The method of claim 16 wherein said dissection lid is made of a replaceable polyethylene.

18. The method of claim 16 wherein said dissection lid is a two piece lid, each portion of said lid is connected to the table via hinges.

19. The method of claim 16 wherein the table having a wheel at each corner thereof.

20. The method of claim 16 wherein said table having a handle on an end thereof and a U-shaped bar arranged on said end.

* * * * *